US009668538B2

(12) United States Patent
Feng et al.

(10) Patent No.: US 9,668,538 B2
(45) Date of Patent: Jun. 6, 2017

(54) SYSTEM AND METHOD FOR COLORING ARTICLES

(71) Applicant: Nike, Inc., Beaverton, OR (US)

(72) Inventors: Ye Feng, Guangzhou (CN); Jared S. Baggen, Portland, OR (US); Anna Schoborg, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 11 days.

(21) Appl. No.: 13/791,643

(22) Filed: Mar. 8, 2013

(65) Prior Publication Data

US 2014/0250610 A1 Sep. 11, 2014

(51) Int. Cl.

| | |
|---|---|
| ***A43B 13/00*** | (2006.01) |
| ***A43D 95/06*** | (2006.01) |
| ***A43B 1/00*** | (2006.01) |

(52) U.S. Cl.

CPC ..... *A43B 13/00* (2013.01); *A43B 1/0027* (2013.01); *A43D 95/06* (2013.01)

(58) Field of Classification Search

CPC ..... A43B 13/00; A43B 1/0029; A43B 1/0027; A43D 95/06

USPC ..... 8/478, 506

See application file for complete search history.

(56) References Cited

U.S. PATENT DOCUMENTS

| | | | | |
|---|---|---|---|---|
| 3,063,281 | A * | 11/1962 | Bell et al. | 68/188 |
| 3,670,698 | A | 6/1972 | Joosten | |
| 3,938,952 | A | 2/1976 | McNeill | |
| 3,951,599 | A | 4/1976 | Davis et al. | |
| 4,183,156 | A | 1/1980 | Rudy | |
| 4,219,945 | A | 9/1980 | Rudy | |
| 4,307,521 | A | 12/1981 | Inohara et al. | |
| 4,321,721 | A | 3/1982 | Painter et al. | |
| 4,936,029 | A | 6/1990 | Rudy | |
| 4,965,099 | A | 10/1990 | Bornhorst | |
| 5,042,176 | A | 8/1991 | Rudy | |
| 5,096,457 | A | 3/1992 | Nakagawa et al. | |
| 5,713,141 | A | 2/1998 | Mitchell et al. | |
| 5,935,273 | A | 8/1999 | Kruger et al. | |
| 5,952,065 | A | 9/1999 | Mitchell et al. | |
| 6,013,340 | A | 1/2000 | Bonk et al. | |
| 6,082,025 | A | 7/2000 | Bonk et al. | |
| 6,094,947 | A | 8/2000 | Scatizzi | |
| 6,127,026 | A | 10/2000 | Bonk et al. | |
| 6,203,868 | B1 | 3/2001 | Bonk et al. | |
| 6,299,817 | B1 | 10/2001 | Parkinson | |
| 6,321,465 | B1 | 11/2001 | Bonk et al. | |
| 6,581,418 | B1 | 6/2003 | Kim | |
| 6,733,543 | B2 | 5/2004 | Pyles et al. | |
| 6,749,646 | B2 | 6/2004 | Pyles et al. | |
| 7,003,900 | B2 | 2/2006 | Trommer | |
| 7,611,547 | B2 | 11/2009 | Bracken et al. | |
| 7,655,054 | B2 | 2/2010 | Weathersbee | |
| 7,841,105 | B2 | 11/2010 | Wyszynski et al. | |
| 7,906,199 | B2 | 3/2011 | Rearick et al. | |
| 7,966,750 | B2 | 6/2011 | Schindler et al. | |
| 8,127,469 | B2 | 3/2012 | Keenan et al. | |
| 2002/0050077 | A1 | 5/2002 | Wang et al. | |
| 2004/0041292 | A1 | 3/2004 | Chen et al. | |
| 2005/0125916 | A1 | 6/2005 | Pyles et al. | |
| 2005/0217150 | A1 | 10/2005 | Hoffer et al. | |
| 2006/0105128 | A1* | 5/2006 | Zeng | 428/35.7 |
| 2007/0045898 | A1 | 3/2007 | Yang | |
| 2007/0175576 | A1 | 8/2007 | Dojan et al. | |
| 2007/0294841 | A1 | 12/2007 | Thullen et al. | |
| 2008/0066342 | A1 | 3/2008 | Park | |
| 2008/0184595 | A1 | 8/2008 | Schindler et al. | |
| 2009/0089942 | A1* | 4/2009 | Pyles et al. | 8/515 |
| 2009/0178301 | A1 | 7/2009 | Dojan et al. | |
| 2010/0122476 | A1 | 5/2010 | Le et al. | |
| 2011/0232135 | A1 | 9/2011 | Dean et al. | |
| 2011/0283560 | A1 | 11/2011 | Portzline et al. | |
| 2012/0042540 | A1 | 2/2012 | Miner | |
| 2014/0250609 | A1 | 9/2014 | Tutmark et al. | |
| 2014/0250611 | A1 | 9/2014 | Schoborg et al. | |
| 2014/0256468 | A1 | 9/2014 | Tutmark et al. | |

FOREIGN PATENT DOCUMENTS

| | | | |
|---|---|---|---|
| CN | 1446056 | A | 10/2003 |
| CN | 1894464 | A | 1/2007 |
| CN | 101082156 | A | 12/2007 |

(Continued)

OTHER PUBLICATIONS

Translation Okamoto JP H06240587, 4 pages, Aug. 3, 2015.*
U.S. Appl. No. 13/786,031, filed Mar. 5, 2013.
U.S. Appl. No. 13/786,043, filed Mar. 5, 2013.
U.S. Appl. No. 13/786,056, filed Mar. 5, 2013.
International Search Report and Written Opinion mailed Dec. 11, 2014 in PCT/US2014/021703.
International Search Report and Written Opinion mailed Sep. 3, 2014 in PCT/US2014/021716.

(Continued)

*Primary Examiner* — Amina Khan

(74) *Attorney, Agent, or Firm* — Honigman Miller Schwartz and Cohn LLP; Matthew H. Szalach; Jonathan P. O'Brien

(57) ABSTRACT

A method and apparatus for coloring an article includes fastening an article to a container which at least partially encloses the article. The article fastens to the container in a fixed position. A portion of the container is inserted into a liquid by an actuator. The liquid enters the container through an open end. An air pocket is created in the container when it is inserted into the liquid. A first portion of the article is contained within the air pocket and a second portion of the article is dipped into the liquid and thereby is colored from a dye in the liquid. The actuator also removes the container and the article from the liquid. The process can be repeated with the article in an inverted position and with another liquid to color another portion of the article a second color.

18 Claims, 16 Drawing Sheets

(56) References Cited

FOREIGN PATENT DOCUMENTS

| | | | | |
|---|---|---|---|---|
| CN | 101165266 | A | | 4/2008 |
| CN | 101195952 | A | | 6/2008 |
| CN | 101408002 | A | | 4/2009 |
| CN | 101578054 | A | | 11/2009 |
| CN | 101905208 | A | | 12/2010 |
| DE | 1 685 433 | | | 7/1971 |
| EP | 2 050 866 | | | 4/2009 |
| FR | 1 547 431 | | | 11/1968 |
| FR | 2 682 130 | | | 4/1993 |
| GB | 610486 | | * | 4/1946 |
| GB | 1555116 | A | | 11/1979 |
| JP | S5095372 | U | | 8/1975 |
| JP | H06240587 | | | 8/1984 |
| JP | H06240587 | | * | 8/1994 |
| JP | 2000158560 | | | 6/2000 |
| JP | 2004285515 | A | | 10/2004 |
| JP | 2010032845 | A | | 2/2010 |
| JP | 2012113954 | A | | 6/2012 |
| WO | 9115973 | | | 10/1991 |
| WO | 2014/138569 | | | 9/2014 |
| WO | 2014/138573 | | | 9/2014 |
| WO | 2014/138576 | | | 9/2014 |
| WO | 2014/138621 | | | 9/2014 |

OTHER PUBLICATIONS

International Search Report and Written Opinion mailed Dec. 16, 2014 in PCT/US2014/021729.
International Search Report and Written Opinion mailed Dec. 15, 2014 in PCT/US2014/021890.
Reebok Sole Trainer, Jan. 16, 2008.
Nike Air Trainer SC, May 2011.
USPTO, Non-Final Office Action for U.S. Appl. No. 14/199,422, mailed Feb. 11, 2016.
Taiwan Intellectual Property Office (R.O.C.), Office Action for Taiwan Patent Application No. 103108311, mailed Aug. 5, 2015.
State Intellectual Property Office (P.R.C.), Chinese Office Action for Application No. 201480013070.9, mailed Jul. 25, 2016.
Japan Patent Office, Notice of Reasons for Rejection for JP Application No. 2015-561710, mailed Aug. 15, 2016.
Canadian Intellectual Property Office, Examination Report for CA Application No. 2,903,491, mailed Sep. 14, 2016.
Derwent 1990-356732, Mathieu 1990.
USPTO, Final Office Action for U.S. Appl. No. 14/199,381, mailed Oct. 20, 2016.
State Intellectual Property Office, Chinese Office Action for Application No. 201480013036.1, mailed Nov. 29, 2016.
State Intellectual Property Office, Chinese Office Action for Application No. 201480013030.4, mailed Dec. 26, 2016.

* cited by examiner

SYSTEM AND METHOD FOR COLORING ARTICLES

BACKGROUND

The present embodiments relate generally to articles of footwear, and in particular to articles of footwear with sole systems.

Articles of footwear generally include two primary elements: an upper and a sole system. The upper is often formed from a plurality of material elements (e.g., textiles, polymer sheet layers, foam layers, leather, synthetic leather) that are stitched or adhesively bonded together to form a void on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust the fit of the footwear, as well as permitting entry and removal of the foot from the void within the upper.

Sole systems can include one or more components or components. These can include outsoles, midsoles, insoles, inserts, bladders and/or airbags as well as possibly other articles or components.

SUMMARY

In one aspect, a method of coloring an article includes fastening an article to a container, inserting at least a portion of the container into a liquid including a coloring agent associated with a color, creating an air pocket within the container, where a first portion of the article is disposed within the air pocket of the container and introducing a second portion of the article into the liquid, thereby coloring the second portion of the article with the color.

In another aspect, a method of making a colored article includes positioning an article relative to a first liquid, the first liquid including a first coloring agent associated with a first color, inserting a first portion of the article into the liquid, thereby coloring the first portion of the article with the color, removing the first portion of the article from the liquid, allowing the first portion to dry and inverting an orientation of the article. The method also includes inserting a second portion of the article into a second liquid, the second liquid including a second coloring agent associated with a second color, thereby coloring the second portion of the article with the second color, removing the second portion of the article from the second liquid and allowing the second portion to dry.

In another aspect, an apparatus for making a colored article includes a container having an open end, at least one fastening member configured to fasten an article within the container in a fixed position and an actuator introducing the container into a liquid including a coloring agent, where the open end allows the liquid to contact a first portion of the article, while suspending a second portion of the article above the liquid.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
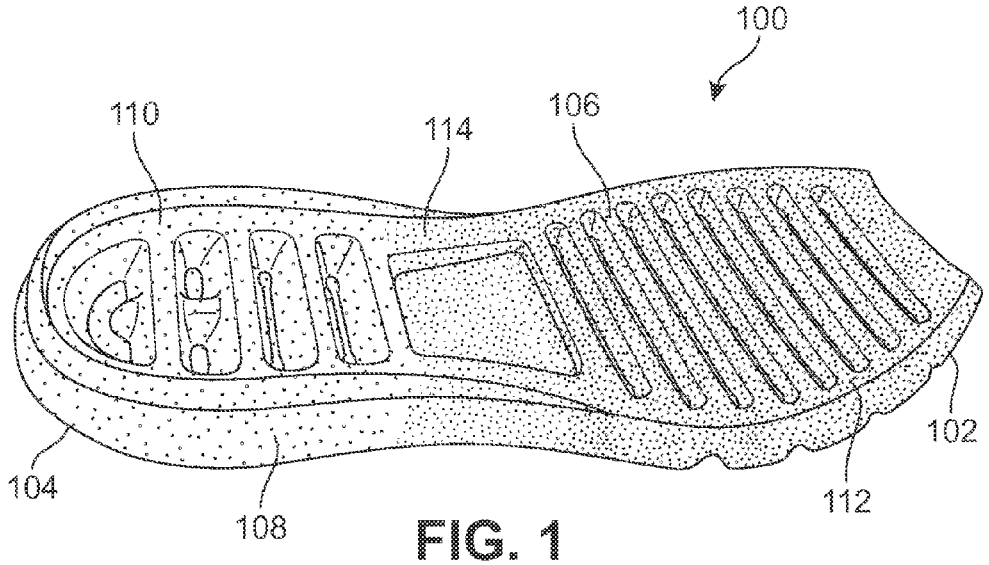
FIG. 1 is a schematic isometric view of an embodiment of a multi-colored article.
Figure 2:
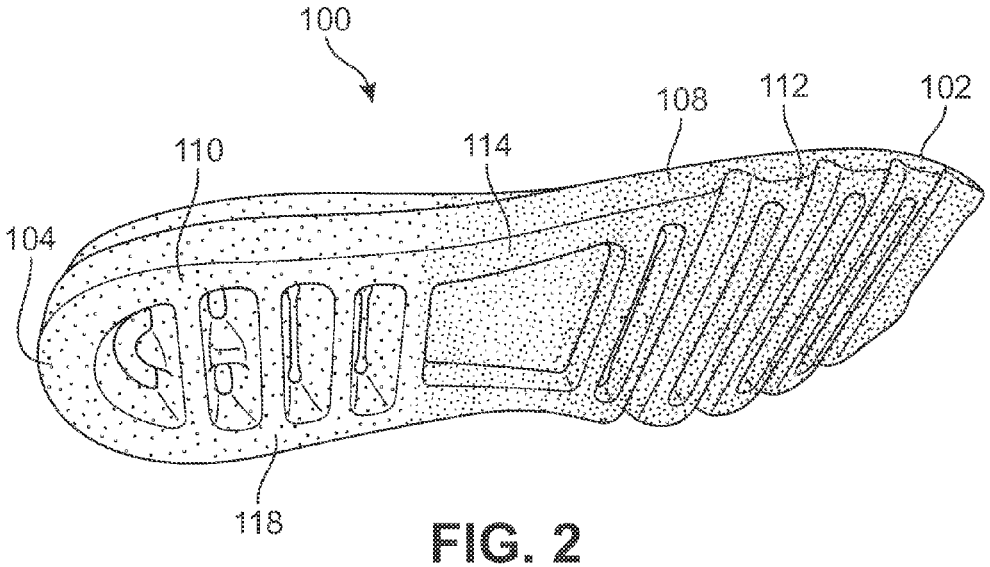
FIG. 2 is a different schematic isometric view of an embodiment of a multi-colored article.

FIGS. 1 and 2 are perspective views of an embodiment of a multicolored article 100. Article 100 may generally be associated with a sole system or sole structure for an article of footwear. In some embodiments, for example, article 100 could comprise a bladder member or airbag that is incorporated into a sole system. In some embodiments, article 100 could be further attached to additional components of a sole system including an outsole, midsole and/or insole. Moreover, it will be understood that article 100 could be used with any kind of sole system and type of footwear (e.g., running shoes, basketball shoes, football shoes, soccer shoes, boots, loafers, sandals, etc.).

Referring to FIGS. 1 and 2, article 100 may include front foot portion 102 and heel portion 104. In addition, article 100 includes a top side 106 (shown in FIG. 1) and a bottom side 118 (shown in FIG. 2). Top side 106 of article 100 would for instance be oriented toward a wearer's foot in an assembled shoe. Bottom side 108 may oriented towards a lower or ground contacting portion of a shoe (such as an outsole). Article 100 may further include peripheral edge 108 of article 100 is also partially shown. In some embodiments, peripheral edge 108 may be visible in an assembled sole of an athletic shoe.

In different embodiments, article 100 could have one or more colors. In the present embodiment, article 100 may be provided with at least two distinct colors, first color 110 on heel portion 104 and second color 112 on front foot portion 102. As an example, first color 110 could be yellow, while second color 112 could be blue. However, this example is only one of many possible color combinations and it will be understood that first color 110 and second color 112 could be any colors.

Some embodiments can incorporate transition areas between portions of different colors. In one embodiment, a transition area 114 can be disposed between heel portion 104 and front foot portion 102. In some embodiments, transition area 114 can be a blend of color 110 and color 112.

As seen in FIGS. 1 and 2, first color 110 and second color 112 permeate through article 100 so as to be visible from top side 106 or bottom side 118. Likewise first color 110 and second color 112 may be visible from peripheral edge 108. Although only one side of peripheral edge 108 is shown in FIGS. 1 and 2, it will be understood that the opposing side of peripheral edge 108 may have a substantially similar color pattern.

In some embodiments transition area 114 can be omitted. Instead a line of demarcation between two colors could be visible. In other embodiments only one color may be used to color article 100. In still other embodiments, three or more distinct colors could be used, with or without transition areas between adjacent distinct colors.

Embodiments can include provisions to facilitate coloring an article to achieve the multicolor effect shown in FIGS. 1 and 2 (as well as other possible color schemes). In embodiments where an article is colored using a dye, for example, a system and associated method can include provisions to dye portions of the article, rather than the entire article.

Figure 3:
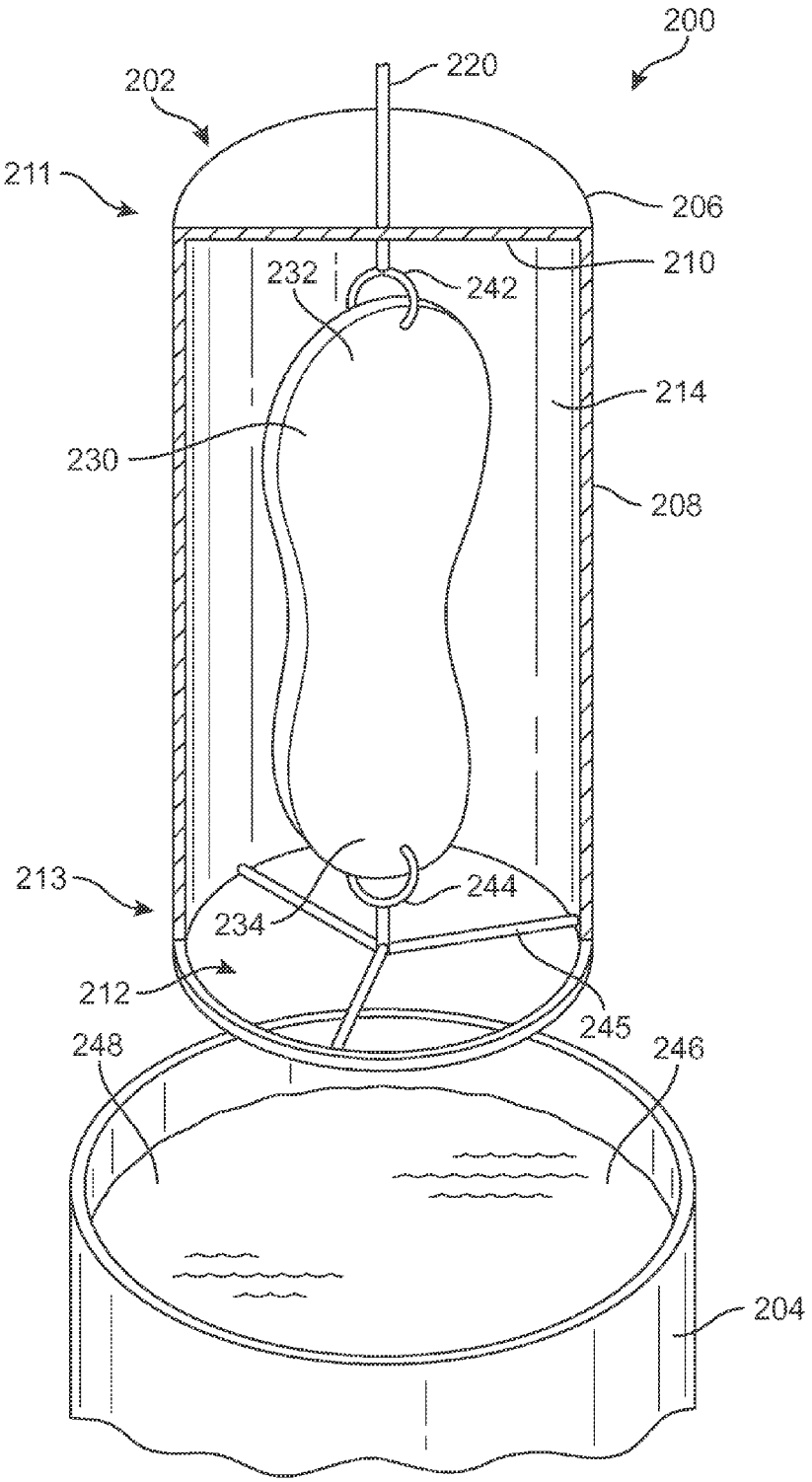
FIG. 3 is a schematic isometric cutaway view of an embodiment of an apparatus used to produce a multicolored article.

FIG. 3 is a cutaway isometric view of an embodiment of an apparatus 200 used to produce multicolored article 100 such as shown in FIGS. 1 and 2. Apparatus 200 may include assembly 202, tank 204 and provisions for maneuvering assembly 202 with respect to tank 204. As discussed in further detail below, assembly 202 is configured to retain an article, while tank 204 may be filled with a liquid coloring agent to be applied to the article.

In some embodiments, assembly 202 may further include a container 206. Container 206 may include a side wall 208. In some embodiments, container may be closed at a first end portion 211 and open at a second end portion 213. In one embodiment, container 206 can include a top wall 210 at first end portion 211 and a bottom opening 212 at second end portion 213. Bottom opening 212 may provide access to an interior 214, which is bounded by side wall 208 and top wall 210.

In different embodiments, the geometry of container 206 could vary. In the exemplary embodiment shown in the figures, container 206 has an approximately cylindrical shape. More specifically, side wall 208 may be a cylindrical wall, while top wall 210 may be circular. However, in other embodiments, container 206 could have any other geometry including, but not limited to: a spherical geometry, a pyramidal geometry, a rectangular prism geometry or any other three-dimensional geometry (including both regular and irregular geometries).

Tank 204 may be configured to retain a liquid coloring agent 246. Here, liquid coloring agent 246 may be associated with a color 248. The term "liquid coloring agent" as used throughout this detailed description and in the claims refers to any liquid that includes or incorporates one or more coloring agents. Liquid coloring agents can include, but are not limited to: liquids with any kinds of coloring agents, including liquids with dyes, liquids with pigments or any other liquid based coloring agents that are known in the art.

The embodiments of the articles described herein may incorporate dyeing methods as well as particular dye compositions. Some embodiments may use one or more of the features, methods, systems and/or components disclosed in the following documents: Tutmark, United States Patent Application Publication 2014/0256468, now U.S. patent application Ser. No. 13/786,031, filed Mar. 5, 2013, titled "Method for Dyeing Golf Balls and Dyed Golf Balls"; Schoborg, United States Patent Application Publication 2014/0250611, now U.S. patent application Ser. No. 13/786,056, filed Mar. 5, 2013, titled "Acid Dyeing of Polyurethane Materials"; Tutmark, United States Patent Application Publication 2014/0250609, now U.S. patent application Ser. No. 13/786,043 filed Mar. 5, 2013, titled "Method for Dyeing Golf Balls and Dyed Golf Balls"; Bracken et al., U.S. Pat. No. 7,611,547, issued Nov. 3, 2009 and titled "Airbag Dyeing Compositions and Processes," where the entirety of each document is incorporated by reference.

For purposes of illustration, tank 204 is shown as having a cylindrical geometry. However, the geometry of tank 204 could vary in other embodiments. In some embodiments, the geometry of tank 204 could be substantially similar to the geometry of container 206. In other embodiments, however, the geometry of tank 204 could be substantially different from the geometry of container 206. Other exemplary geometries for tank 204 include, but are not limited to a spherical geometry, a pyramidal geometry, a rectangular prism geometry or any other three-dimensional geometry (including both regular and irregular geometries).

Embodiments can include provisions to position container 206. In some embodiments, apparatus 200 includes actuator 220 which may used to adjust the position of container 206 relative to tank 204. In some embodiments, actuator 220 could be used to raise and lower container 206 with respect to tank 204. For purposes of illustration, only a portion of an actuator that is in contact with container 206 is shown in the figures. Any suitable type of mechanism can be used to raise and lower container 206. Some examples of possible of devices include linkages, pulley system, ropes, cables, which could be mechanized or manual, for example.

In order to fasten an article within container 206, assembly 202 can include one or more retaining members, which may also be referred to as fastening members. In the exemplary embodiment, upper retaining member 242 and lower retaining member 244 are provided inside the container 206. In particular, upper retaining member 242 may be secured to top wall 210 of container 206. In some embodiments, a retaining member bracket 245 secures lower retaining member 244 to a lower portion of side wall 208. In the example shown, an article 230 is positioned vertically within container 206. Specifically, front foot portion 232 of article 230 is secured in container 206 by upper retaining member 242. Also, heel portion 234 of article 230 is secured in container 206 by lower retaining member 244.

First retaining member 242 and second retaining member 244 can be any suitable means for retaining article 230 inside container 206 in a secure position. Some embodiments may employ clips, clamps, tension rods, hooks, or brackets as retaining members. Still other embodiments could use any other kinds of retaining members known in the art for temporarily fixing or holding an article in place.

As seen in FIG. 3, container 206 may be arranged in an inverted position with respect to tank 204. In particular, second end portion 213, which includes bottom opening 212, is disposed closer to tank 204 than first end portion 211. As described in further detail below, this arrangement allows liquid coloring agent 246 to partially fill interior 214 as container 206 is lowered into tank 204.

In FIG. 3, an embodiment of the assembly 202 is depicted before introducing container 206 into tank 204. Article 230, in an uncolored/un-dyed state is shown disposed inside inverted container 206. In this particular configuration, article 230 is retained at front foot portion 232 and at heel portion 234.

Figure 4:
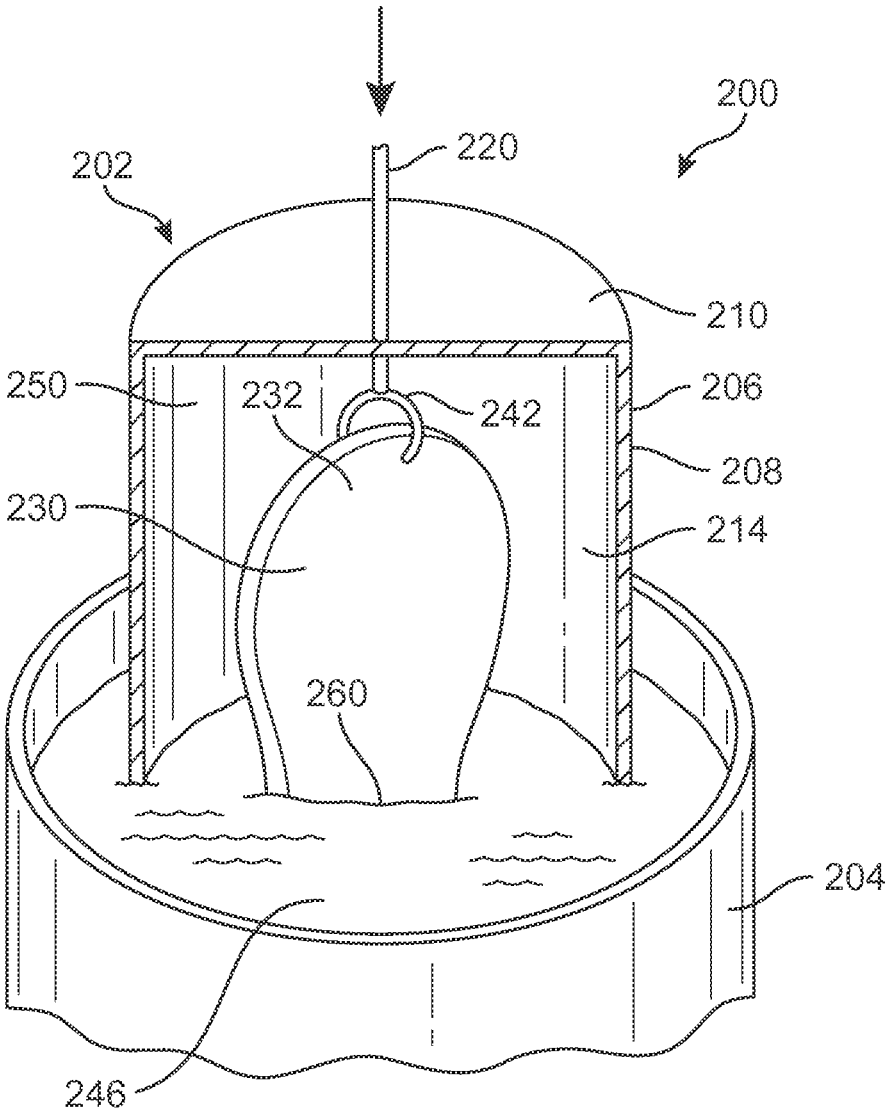
FIG. 4 is different schematic isometric cutaway view of an embodiment of an apparatus used to produce a multicolored article.
Figure 5:
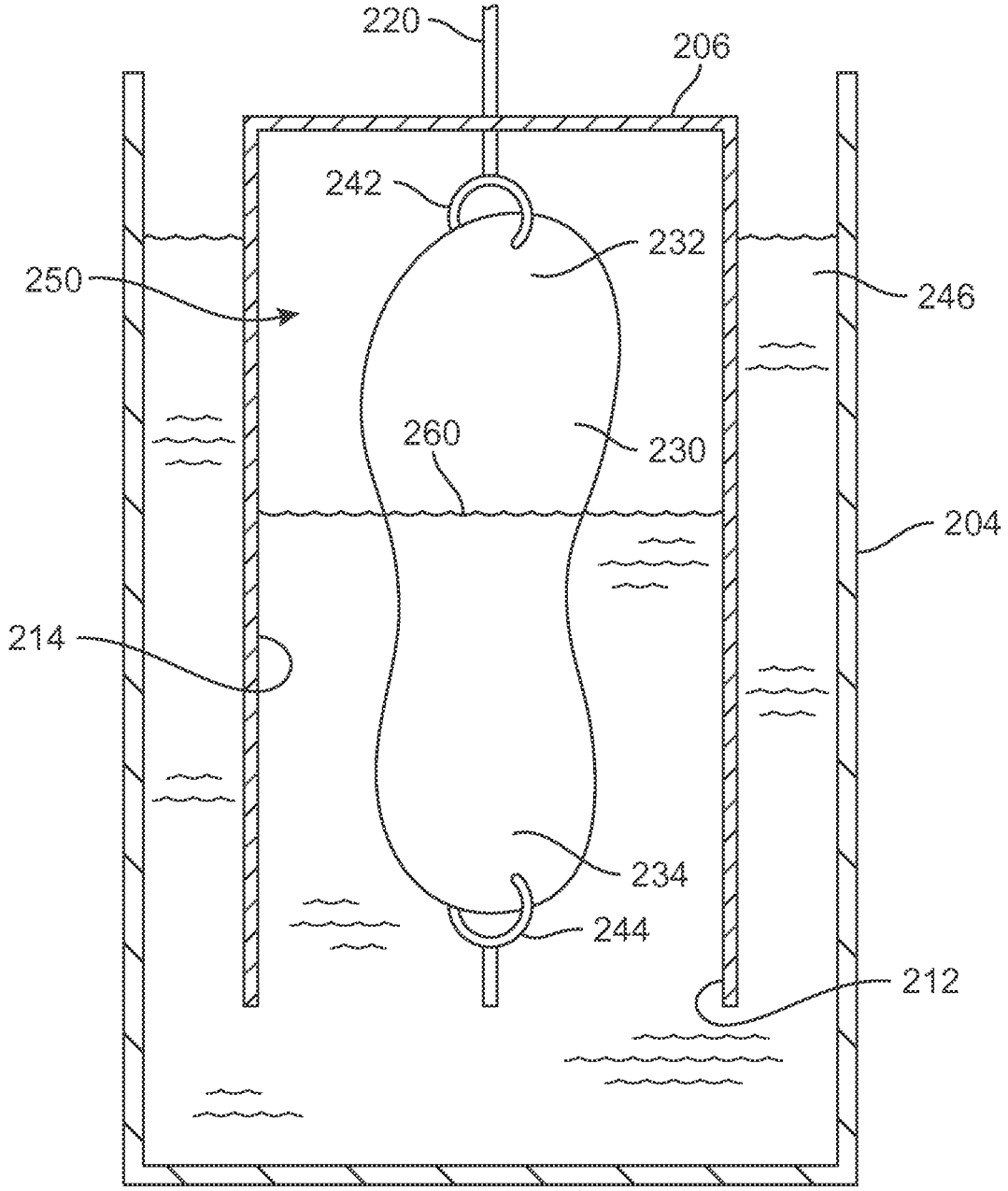
FIG. 5 is a schematic view of an embodiment of an apparatus shown in FIGS. 3 and 4, in a different position.

FIGS. 4 and 5 show an embodiment of assembly 202 in a process of lowering container 206 into tank 204. As discussed above, tank 204 may be filled with liquid coloring agent 246. In some embodiments, liquid coloring agent 246 may comprise a liquid dye. In some embodiments, liquid coloring agent 246 may be a liquid dye with a color 248.

Referring to FIG. 4, actuator 220 lowers container 206 into tank 204 as indicated by a downward pointing arrow. As container 206 is lowered, a portion of container 206 is introduced into tank 204. Bottom opening 212 of container 206 allows for liquid coloring agent 246 to enter interior 214 of container 206.

Air pocket 250 is created as container 206 is lowered into tank 204. In particular, as bottom opening 212 of container 206 comes into contact with liquid coloring agent 246, air within interior 214 of container 206 becomes trapped (or sealed) within container 206. Specifically, the air within interior 214 is captured within the volume bounded by top wall 210, side wall 208 and the surface of liquid coloring agent 246.

In the configuration of FIG. 4, article 230 is shown as partially dipped into liquid coloring agent 246. Heel portion 234 (not visible) is submersed in the liquid coloring agent 246. However, front foot portion 232 in disposed above the surface of liquid coloring agent 246 and within air pocket 250.

In some embodiments, article 100 may be buoyant. For example, in embodiments where article 230 is a bladder member or airbag, article 230 may be especially buoyant and resist being submerged in a liquid. Therefore, upper retaining member 242 and lower retaining member 244 may prevent article 230 from floating while being dipped into liquid coloring agent 246. This arrangement allows open bottom 212 of container 206 to be at least partially submersed below a liquid level in tank 204.

As seen in FIG. 5, the liquid level 260 (also shown in FIG. 4) of liquid coloring agent 246 within the container 206 may vary with the volume of air pocket 250. The volume of air pocket 250 may vary with the depth of submersion of container 206 within tank 204. In particular, as container 206 is further submerged, the volume of air pocket 250 may be further compressed. In some embodiments, the volume of air pocket 250 could be controlled independently from the submersion depth by using other provisions to increase the pressure within air pocket 250 and thereby maintain an approximately constant volume.

With container 206 submerged to a predetermined level within tank 204, liquid level 260 defines the transition between a first portion of article 230 that is outside of liquid coloring agent 246 and a second portion of article 230 submerged within liquid coloring agent 246. Here, the first portion is front foot portion 232 while the second portion is heel portion 234. In other embodiments, however, the first portion and the second portion could be any other portions. By holding container 206 at this depth for a predetermined period of time heel portion 234 of article 230 can be colored by liquid coloring agent 246. In this case, container 206 is shown as mostly, but not entirely submerged within liquid coloring agent 246. In other embodiments, container 206 could be completely submerged within liquid coloring agent 246.

Figure 6:
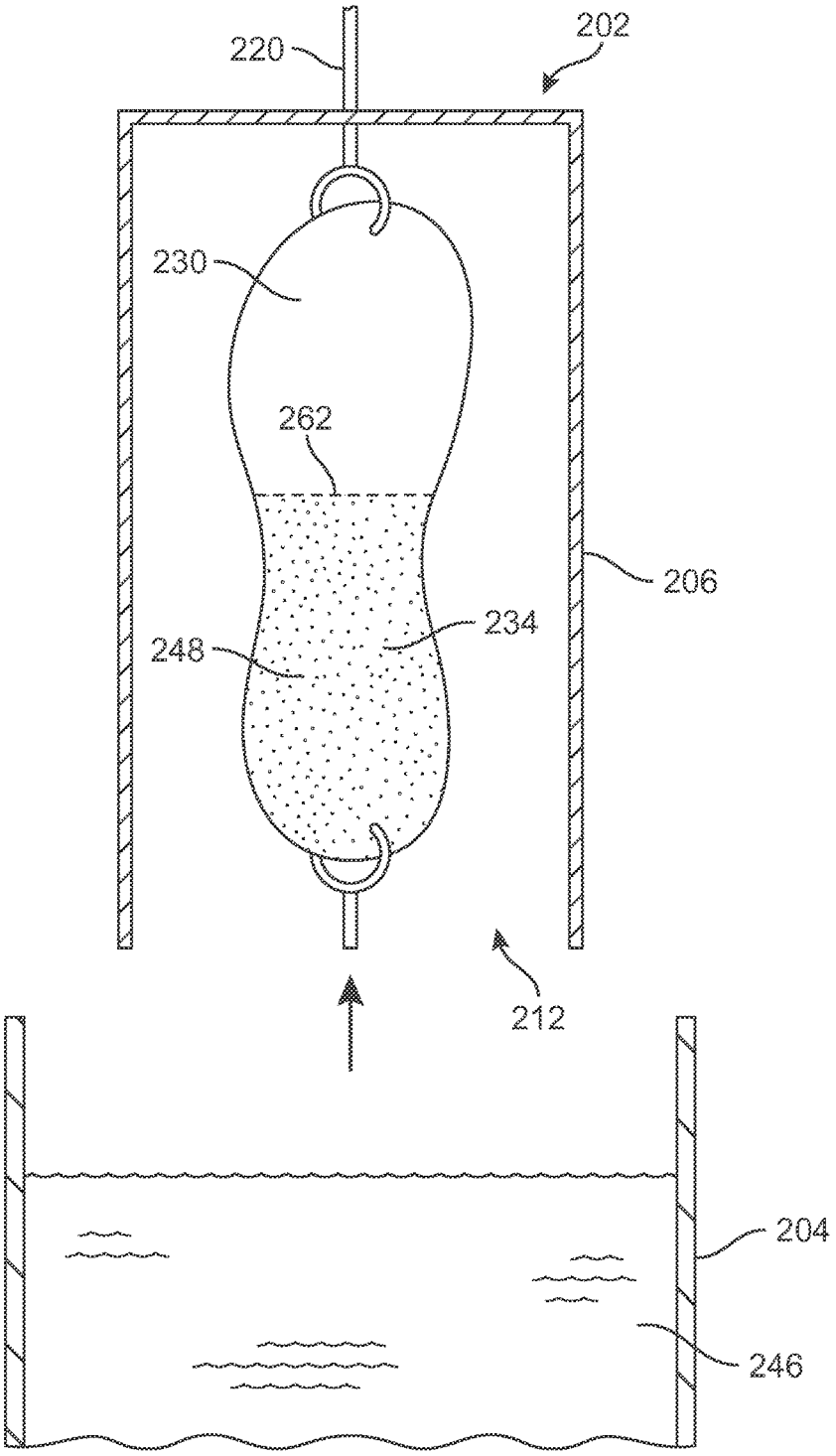
FIG. 6 is a schematic view of an embodiment of an apparatus shown in FIG. 5, in a different position.

FIG. 6 illustrates an embodiment of container 206 being raised from tank 204 through the use of actuator 220. As container 206 is raised, liquid coloring agent 246 can exit container 206 through bottom opening 212. Dipped article 230 is shown having color 248 on heel portion 234 below coloring line 262. According to an exemplary embodiment, article 230 is dipped once into tank 204 to color heel portion 234 of article 230.

In some embodiments article 230 can be dipped any number of times to achieve different coloring effects. Dipping an article multiple times can be used to achieve desired results in color saturation, to provide color transition areas, etc. In some embodiments, multiple successive quick dippings of article 230 achieves faster results than fewer long dips.

Figure 7:
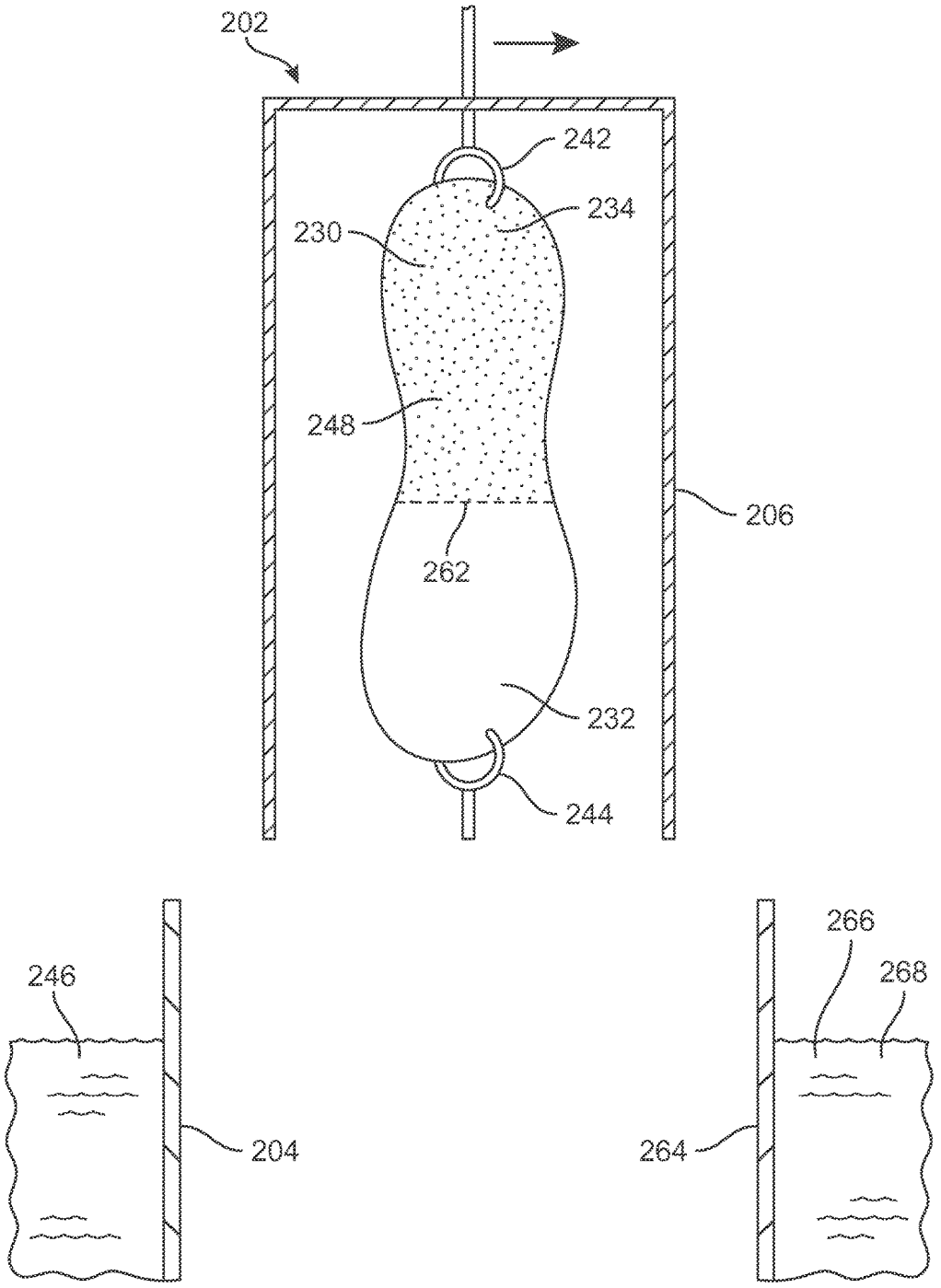
FIG. 7 is a schematic view of an embodiment of an apparatus shown in a different position, with an inverted article.
Figure 8:
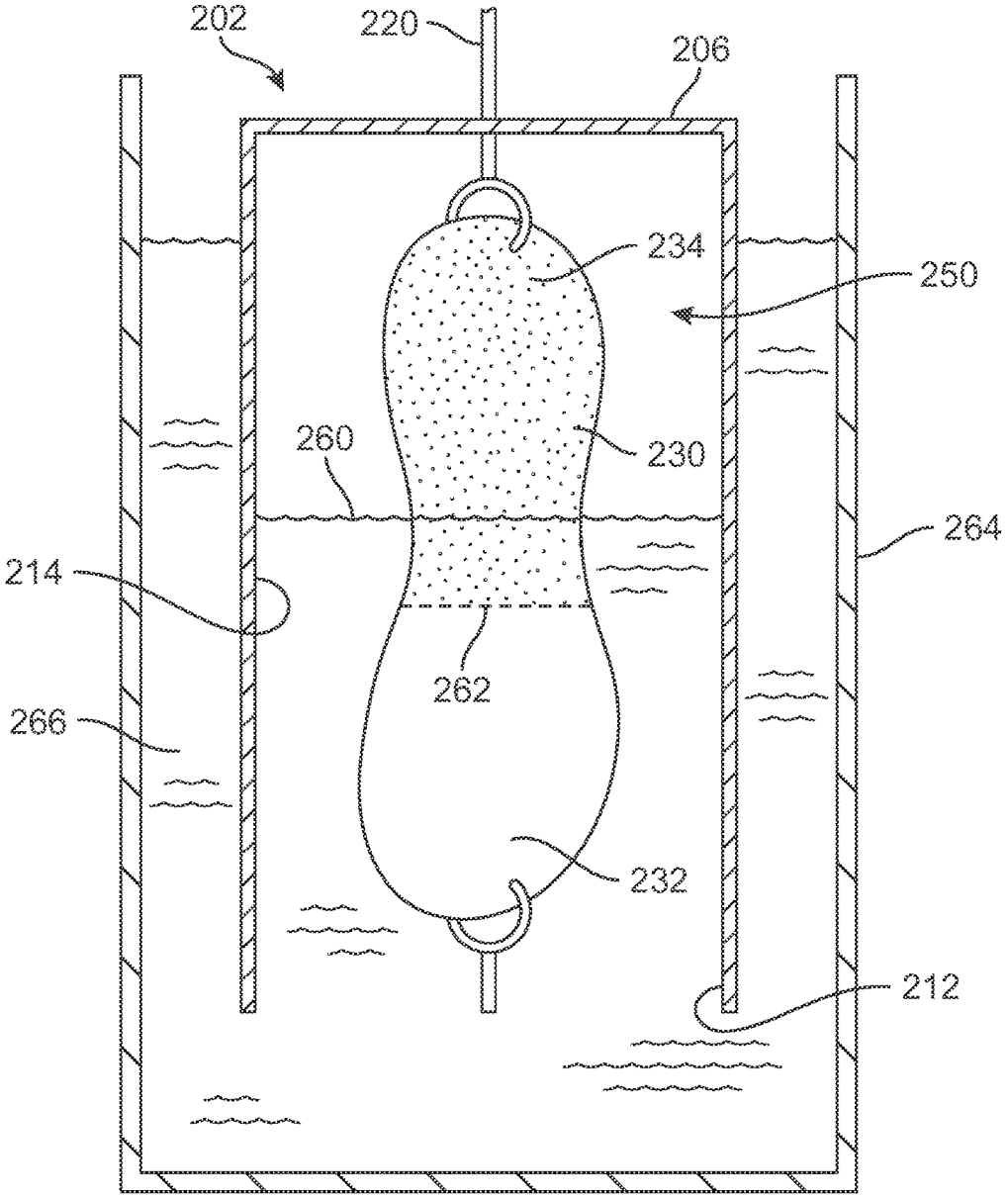
FIG. 8 is a schematic view of an embodiment of an apparatus shown in yet a different position, with an inverted article.
Figure 9:
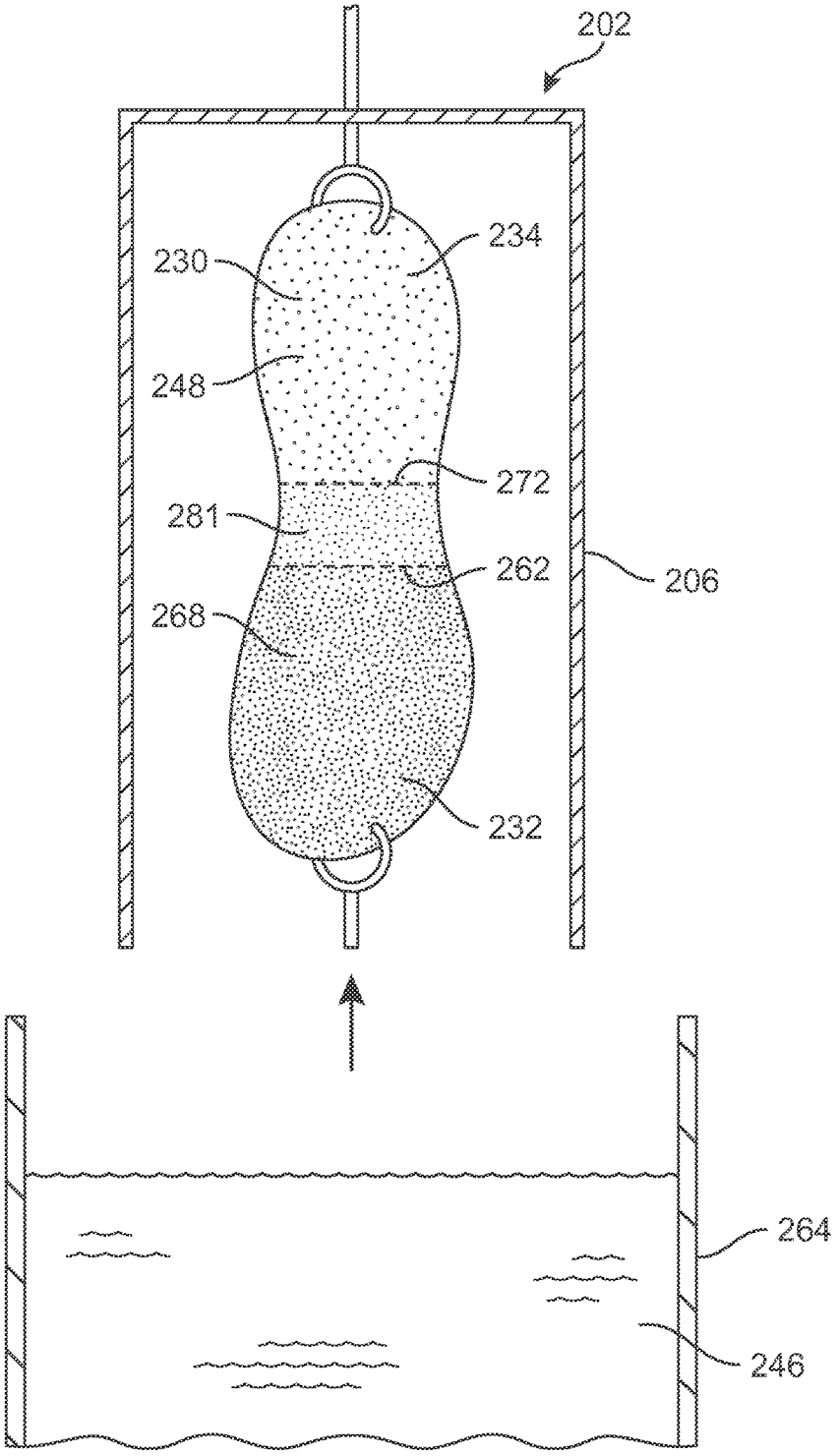
FIG. 9 is a schematic view of an embodiment of an apparatus shown in yet a different position, with an inverted article.

FIGS. 7 through 9 illustrate schematic views depicting several additional steps that may be used to produce a multicolored article, according to an embodiment. It will be understood that these steps are optional and some embodiments may not include them, especially in embodiments where only a single color is desired.

Referring first to FIG. 7, article 230 may be inverted within container 206, with respect to the position of article 230 shown in the previous figures (e.g., FIG. 6). Thus, heel portion 234 is now secured in container 206 by upper retaining member 242. Also front foot portion 232 of article 230 is secured in container 206 by lower retaining member 244. Inverting the article 230 prepares the un-colored front foot portion 232 for dipping into next tank 264.

As also shown in FIG. 7, assembly 202 may be moved/transferred from tank 204 toward next tank 264. This is indicated by the horizontal arrow that is representative of any means for moving assembly 202, such as a conveyer device. This can occur before, after, or during the inversion of article 230 within container 206. Tank 264 may be filled with a liquid coloring agent 266 of color 268. In some embodiments, liquid coloring agent 266 may be a liquid dye. In an exemplary embodiment, color 268 is different from color 248.

In some embodiments any type of mechanism capable of transferring assembly 202 from tank 204 to next tank 264 can be employed. Some examples of possible of devices include, but are not limited to: linkages, pulley systems, ropes, cables, as well as possibly other devices, which could be mechanized or manual.

In some embodiments additional dips of the article may be performed in additional tanks. Additional dips can be for rinsing, coating, or sealing the article, for example. Furthermore some embodiments can include drying operations in between dips of the article. These additional dips or operations can occur before, between, or after the dips of the articles as set forth above.

FIG. 8 shows an embodiment of assembly 202 in step of lowering container 206 into next tank 264. This illustrates a second lowering or dipping of container 206 to dip the un-colored front foot portion 232 of article 230 into next tank 264. In this step, actuator 220 lowers container 206 into tank 264 that is filled with liquid coloring agent 266. Open bottom 212 of container 206 allows for liquid coloring agent 266 to enter interior 214 of container 206. As described previously, air pocket 250 is created as container 206 is lowered into tank 264. In this arrangement, heel portion 234 is shown as being disposed in air pocket 250. In other words, heel portion 234 is not in contact with liquid coloring agent 266.

In the embodiment shown, front foot portion 232 of article 230 is shown as partially dipped into liquid coloring agent 266. In some embodiments, article 230 could be submerged to a point where coloring line 262 is submerged below liquid level 260. This allows some portions of article 230 that have already been colored with color 248 to be additionally colored with liquid coloring agent 266. As discussed below, this creates a color transition region that is a blend of color 248 and color 268. However, in other embodiments, coloring line 262 could be disposed above liquid level 260, such that no portion of article 230 is colored more than once.

FIG. 9 illustrates an embodiment of assembly 202 after the step of dipping container 206 into tank 264. Referring to FIG. 9, dipped article 230 is shown having color 268 on front foot portion 232 below coloring line 262, and color 248 on heel portion 234 above coloring line 272. Coloring line 262 is made while dipping article 230 in tank 204. Coloring line 272 was made when dipping article 230 in tank 264. According to an exemplary embodiment, article 230 is dipped once into tank 264 to dye front foot portion 232 of article 230.

Additionally, in this embodiment, dipped article 230 has a color transition portion 281, which is disposed between coloring line 262 and coloring line 272. Transition portion 281 comprises a blend of color 248 and color 268.

As previously described, in some embodiments article 230 can be dipped any number of times to achieve different coloring effects. Dipping an article multiple times can be used to achieve desired results in color saturation, to provide color transition areas, etc. In some cases, the volume of air pocket 250 within container 206 can be varied in successive multiple dips to achieve varying results.

Figure 10:
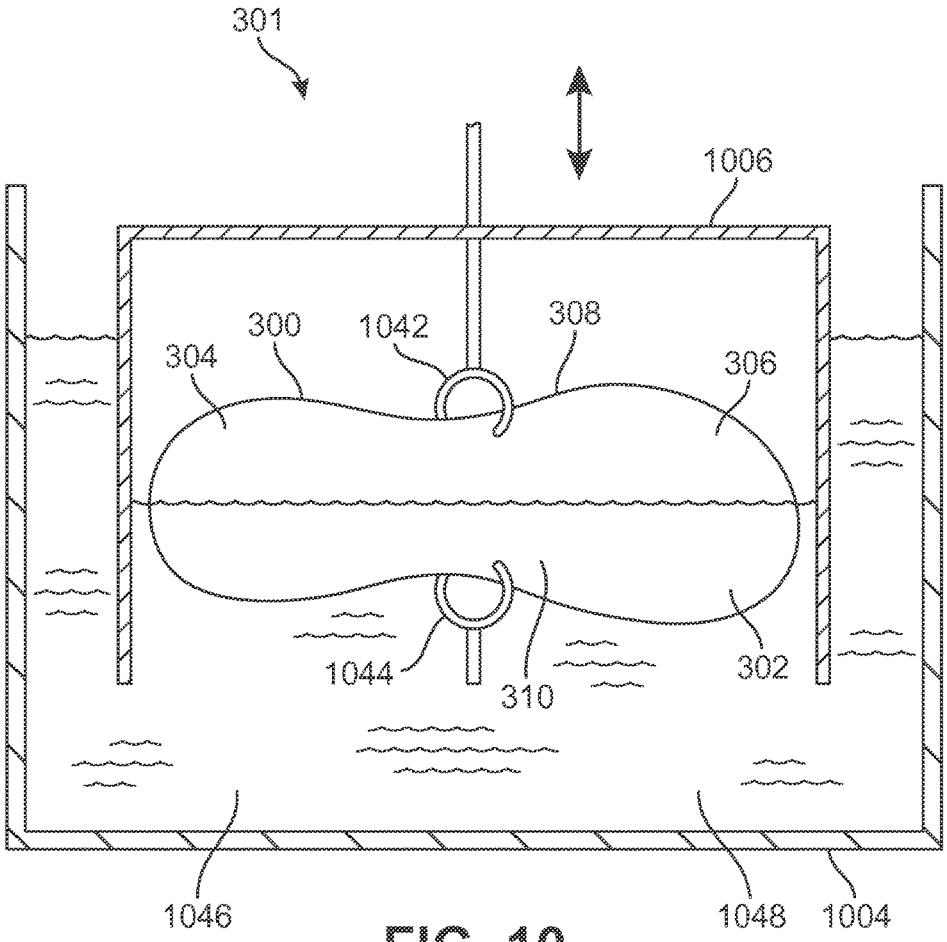
FIG. 10 is a schematic view of an embodiment of an apparatus holding an article in a different position.

FIG. 10 depicts an embodiment having an alternative retaining position of article 300. In the example shown, article 300, which includes a front foot portion 302 and a heel portion 304, is positioned horizontally, rather than vertically as in the previous embodiment. Top side 306 of article 300 is viewed in the plane of the drawing. In this configuration, a lateral peripheral edge portion 308 of article 300 is secured in container 1006 by upper retaining member 1042. Medial peripheral edge portion 310 of article 300 is secured in container 1006 by lower retaining member 244.

Assembly 301 is shown being lowered into tank 1004 filled with liquid coloring agent 1046 of color 1048 for example. The process for coloring article 300 is repeated according to the previous exemplary embodiment discussed above and shown in FIGS. 3 through 8. However, it will be understood that article 300 in the present embodiment is inverted in the container 1006 in a manner (not shown) such that when inverted medial peripheral edge portion 310 is secured in container by upper retaining member 1042. Further, lateral side peripheral edge portion 308 of article 300 is secured in container by lower retaining member 1044 in the inverted position. Container 1006 is then transferred and submerged into another tank for applying another color.

These embodiments show some possible orientations for an article with respect to the surface of a liquid coloring agent. In particular, the embodiments depict configurations where the article may be vertical to the surface (e.g., FIG. 5) or horizontal (e.g., FIG. 10). In other embodiments, the position of the article can be angled relative to the liquid coloring agent surface, rather than being vertically or horizontally oriented.

Figure 11:
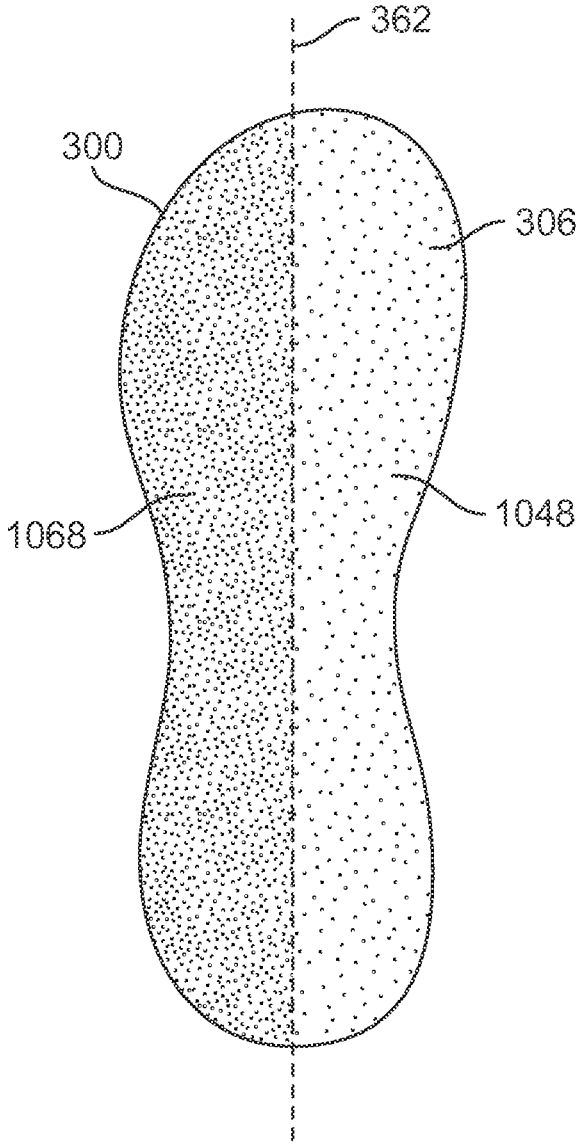
FIG. 11 is a schematic view of an embodiment of a multi-colored article resulting from an apparatus embodied in FIG. 10.

FIG. 11 shows an embodiment of resulting article 300 according to the above described production steps. Multi-colored article 300 is shown with top side 306 viewed in the plane of the drawing. On a medial side of coloring line 362, article 300 is dyed with color 1048. On a lateral side of coloring line 362, article 300 is dyed with another color 1068. Although no transition area is shown, it will be understood that a transition area blending color 1048 and color 1068 could be provided to the medial and lateral sides of coloring line 362. Furthermore, since the colors permeate the article, the colors are visible from the top side 306, bottom side (not shown), and peripheral edges (not shown).

Figure 12:
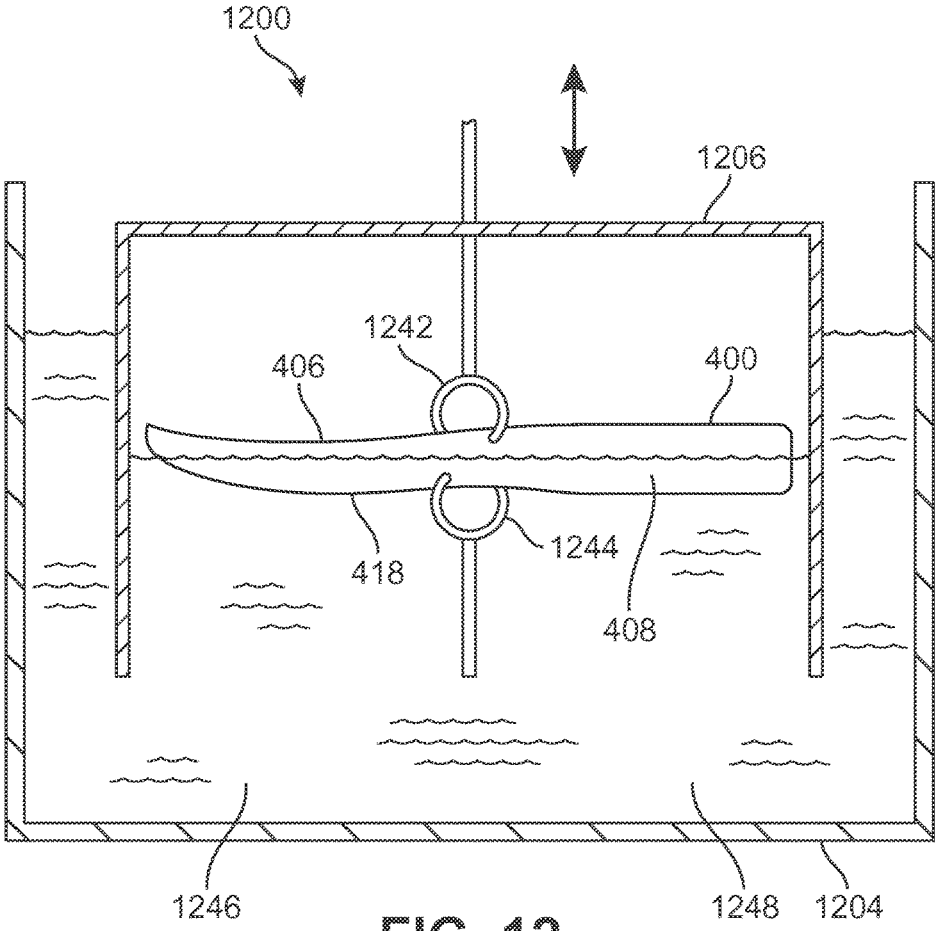
FIG. 12 is a schematic view of an embodiment of an apparatus holding an article in yet a different position.

FIG. 12 illustrates a variation for an embodiment having another alternative retaining position of article 400. In the example shown, the article 400 is again positioned horizontally. However, a side view of article is shown. Peripheral edge 408 is in the plane of the drawing. Top side 406 of article 400 is secured in container 1206 by upper retaining member 1242. Bottom side 418 of article 400 is secured in container 1206 by lower retaining member 1244.

Assembly 1200 is shown lowered into tank 1204 filled with liquid coloring agent 1246 of color 1248 for example. The process for dying article 400 is repeated according to the first exemplary embodiment discussed above and shown in FIGS. 3 through 8. However, it will be understood that article 400 in the present embodiment is inverted in container 1206 in a manner (not shown) such that bottom side 418 is secured in container 1206 by upper retaining member 1242. Further, top side 406 of article is secured in container 1206 by lower retaining member 1244. Container 1206 can then transferred and submerged into another tank.

Figure 13:
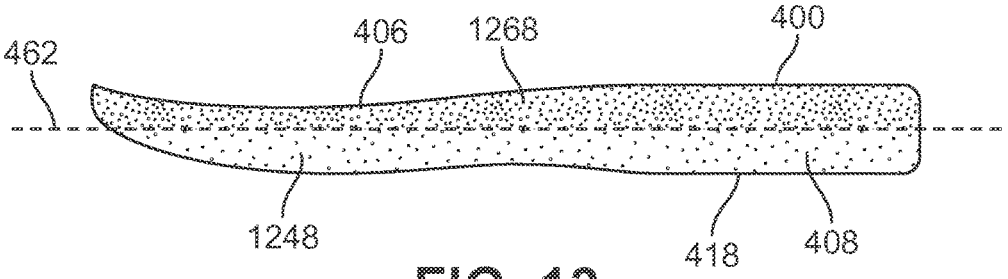
FIG. 13 is a schematic view of an embodiment of a multi-colored article resulting from an apparatus embodied in FIG. 12.

FIG. 13 shows an embodiment of resulting article 400 according to the above described steps. Multi-colored article 400 is shown with peripheral edge 408 visible. Bottom side 418 of article 400 is dyed with color 1248 below coloring line 462. Top side 406 of article 400 is dyed with color 1268 above dye line 462. Although no transition area is shown, it will be understood that a transition area blending color 1248 and color 1268 could be provided above and below coloring line 462. Furthermore, since the dye colors permeate the article, the colors are visible from the top side 406, bottom side 418, and peripheral edge 408.

Embodiments can include provisions for coloring multiple articles simultaneously within a single tank of liquid coloring agent. For example, some embodiments could include provisions for retaining multiple articles at the same height within a container, thereby allowing the multiple articles to be colored simultaneously. As another example, some embodiments could incorporate assemblies with stacked containers, where one or more articles can be colored within each container and where the entire assembly could be submerged into a tank of liquid coloring agent.

Figure 14:
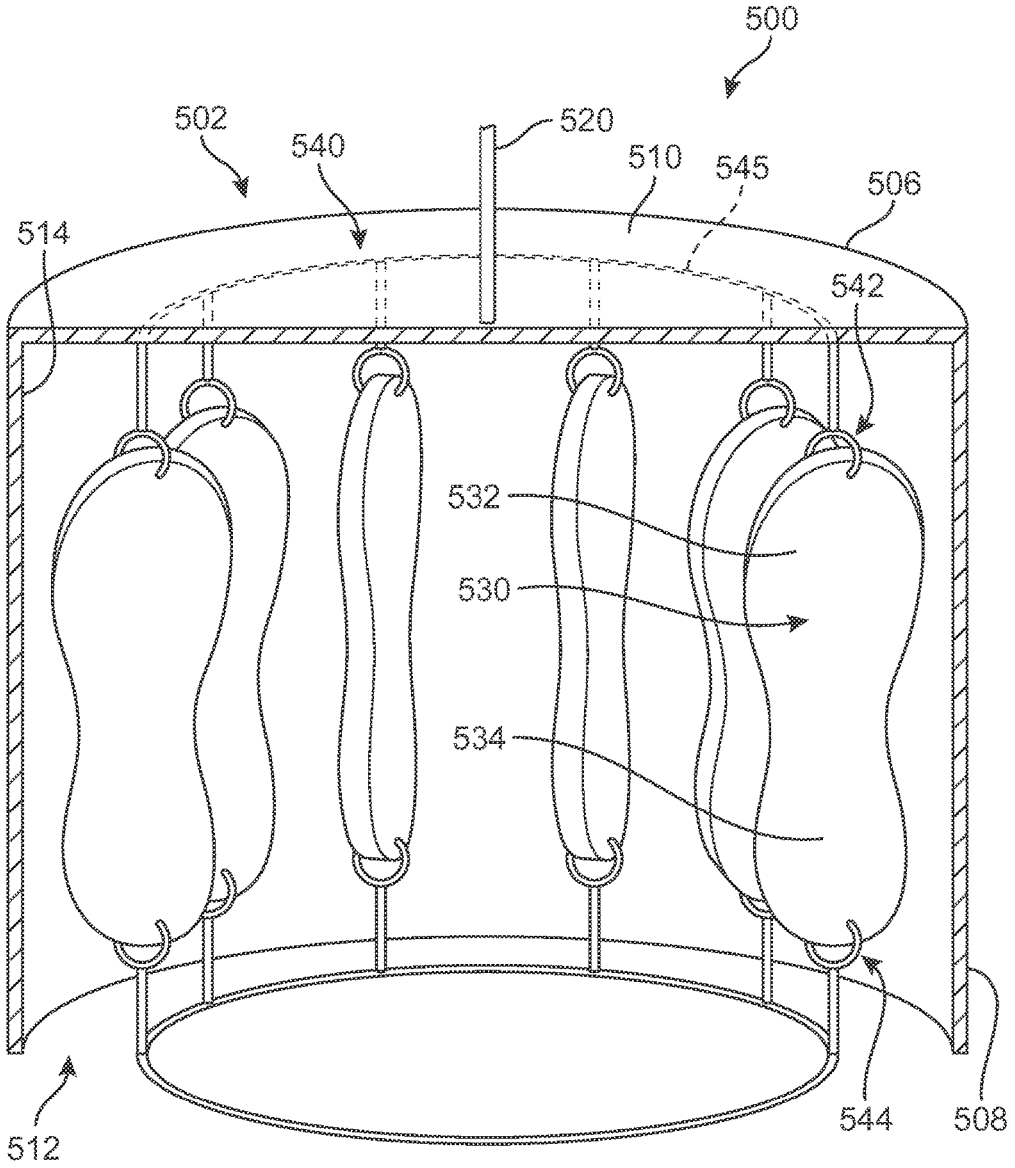
FIG. 14 is a schematic isometric cutaway view of an embodiment of an apparatus used to produce multiple multicolored articles.

FIG. 14 is a cutaway isometric view of an embodiment of apparatus 500 for dipping multiple articles 530 simultaneously. Apparatus 500 includes assembly 502. Assembly 502 has an inverted container 506, which may include a side wall 508 and a top wall 510. Container 506 may have a bottom opening 512 at a lower end. In operation, container 506 can be raised and lowered by actuator 520 into a tank (not shown for simplicity). Any suitable type of mechanism can be used as an actuator 520 to raise and lower container 506.

A carousel 540 for mounting multiple articles 530 is disposed inside the container. Carousel 540 includes a cylindrical bracket 545 mounted to the interior 514 of container 506. Cylindrical bracket 545 is provided with upper retaining members 542 and lower retaining members 544 which are axially spaced from each other. Upper retaining members 542 and lower retaining members 544 are secured at their upper and lower ends by the cylindrical bracket 545. In the present example, multiple articles 530 are shown being secured within cylindrical bracket 545 in a vertical position.

Uncolored/un-dyed articles 530 are positioned in carousel 540. Articles 530 are retained at their respective front foot portions 532 and at heel portions 544. Upper retaining members 542 and lower retaining members 544 can be any suitable means for retaining articles into cylindrical bracket, as described previously with respect to other embodiments. Front foot portions 532 of articles 530 are secured in cylindrical bracket 545 by upper retaining members 542. Heel portions 534 of articles 530 are secured in cylindrical bracket 545 by lower retaining members 544.

Figure 15:
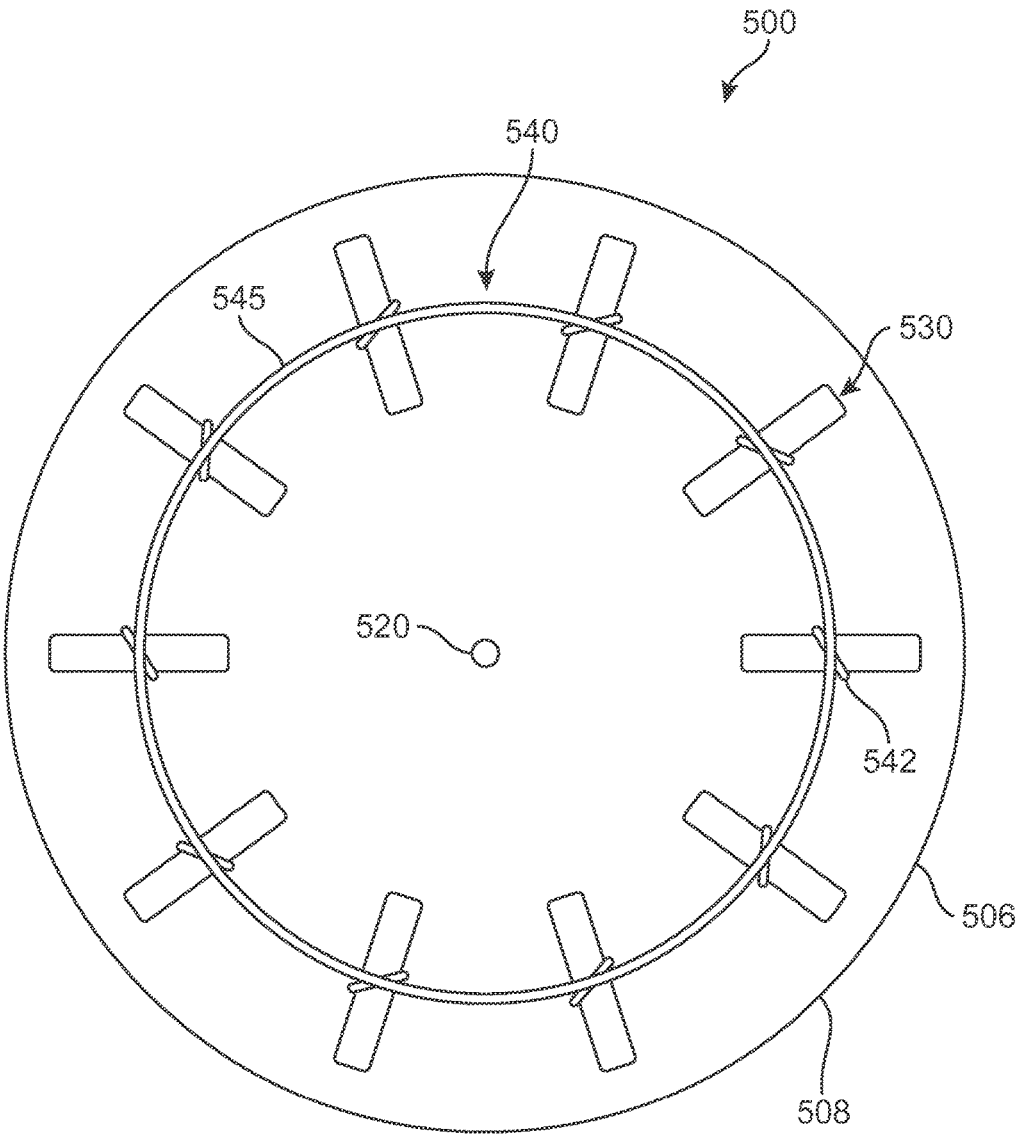
FIG. 15 is a schematic plan view of an apparatus embodied in FIG. 14.

FIG. 15 is a top view of an embodiment of apparatus 500. Carousel 540 is shown holding multiple articles 530 in axially spaced positions. Cylindrical bracket 545 supports ten articles 530 in the present example. In other embodiments carousel 540 and bracket 545 can be any shape, such as square, rectangular, oval, spherical, or pyramidal, for example. Furthermore, in some embodiments bracket can be provided with any number of upper retaining members 542 and lower retaining members 544 (not shown) to hold multiple articles.

Figure 16:
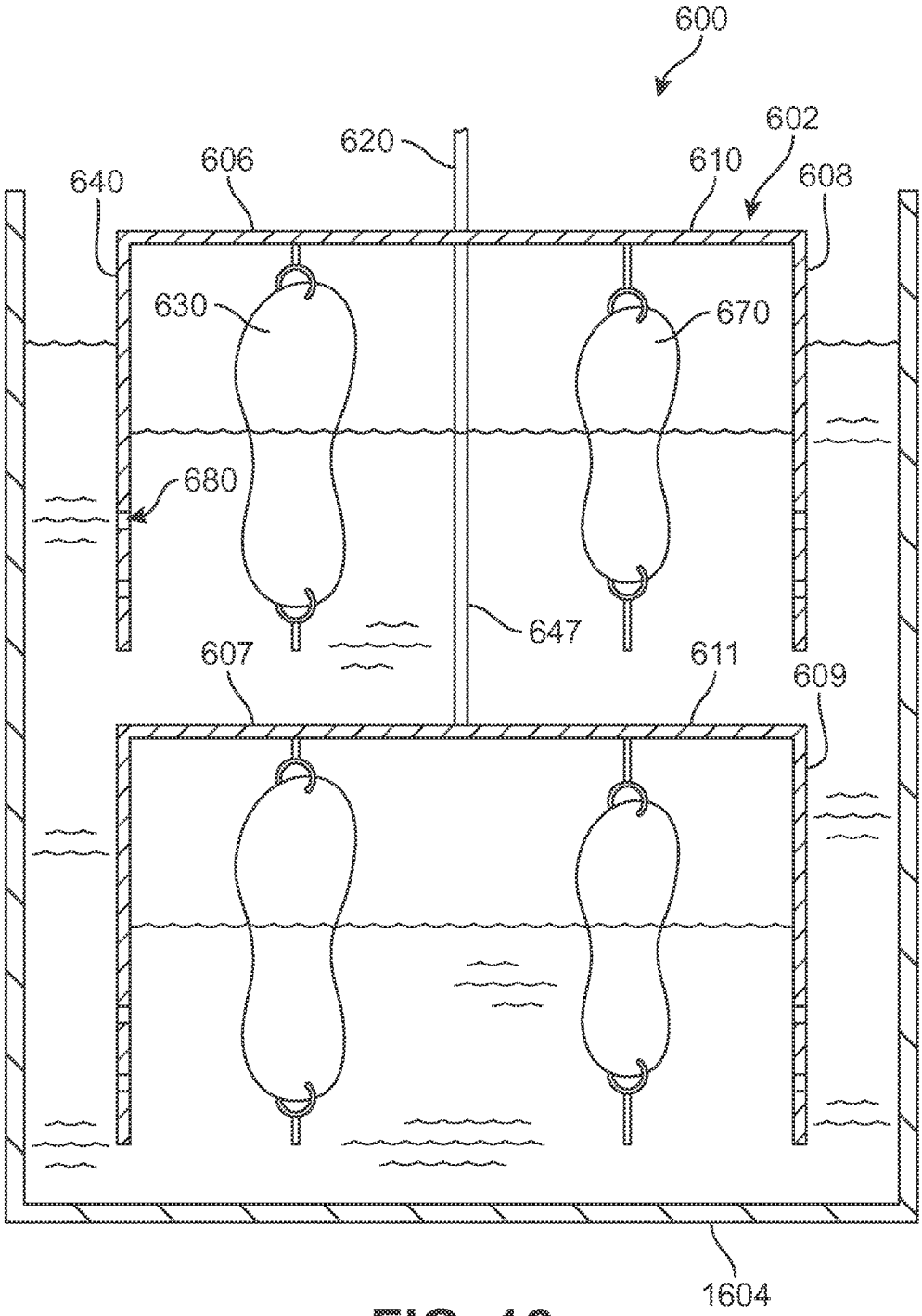
FIG. 16 is a schematic view of another embodiment of an apparatus used to produce multiple multicolored articles.

FIG. 16 shows an embodiment of assembly 600. Apparatus 600 includes assembly 602. Assembly 602 has two inverted containers including first container 606 and second container 607. First container 606 and second container 607 may be vertically stacked and connected by a connector 647 (for example, a rod). First container 606 and second container 607 include first top wall 610 and second top wall 611, respectively. Additionally, first container 606 and second container 607 include first side wall 608 and second side wall 609, respectively. Furthermore, each of first container 606 and second container 607 may be open at their lower ends.

For purposes of clarity, first container 606 and second container 607 are shown in cross-section. However, it will be understood that the geometry of each container could vary in different embodiments. Furthermore, in this embodiment, each container is shown without any bracket details for simplicity. Also, each container is shown holding only two articles for simplicity. The articles 630 are positioned for example in the same manner as in the previous embodiment.

In some embodiments with multiple containers, the containers can be positioned side by side, rather than stacked vertically.

Apparatus 600 includes actuator 620 which is used to raise and lower containers 606. Containers 606 can be raised and lowered by actuator 620. Any suitable type of mechanism can be used to raise and lower containers 606, as previously described.

Tank 1604 is shown as a vessel containing a liquid coloring agent, as the previous examples. The assembly 602 is shown lowered into in tank 1604. In this configuration, second container 607 is shown in FIG. 16 as being completely submerged in tank 1604. In contrast, first container 606 is shown as only partially submerged in tank 1604.

Embodiments can also include provisions to control the amount of water entering a container. For example, container 606 and container 607 of the current embodiment include holes 680 that may be used to allow more water into container 606 and container 607. Other embodiments could incorporate any other holes in any other locations.

Furthermore, different sizes of articles are being held inside the container, which is advantageous for producing the same pattern on different sized articles in one batch. For example, the embodiment includes a first sized article 630 and a second sized article 670 retained within the same container 606.

Figure 17:
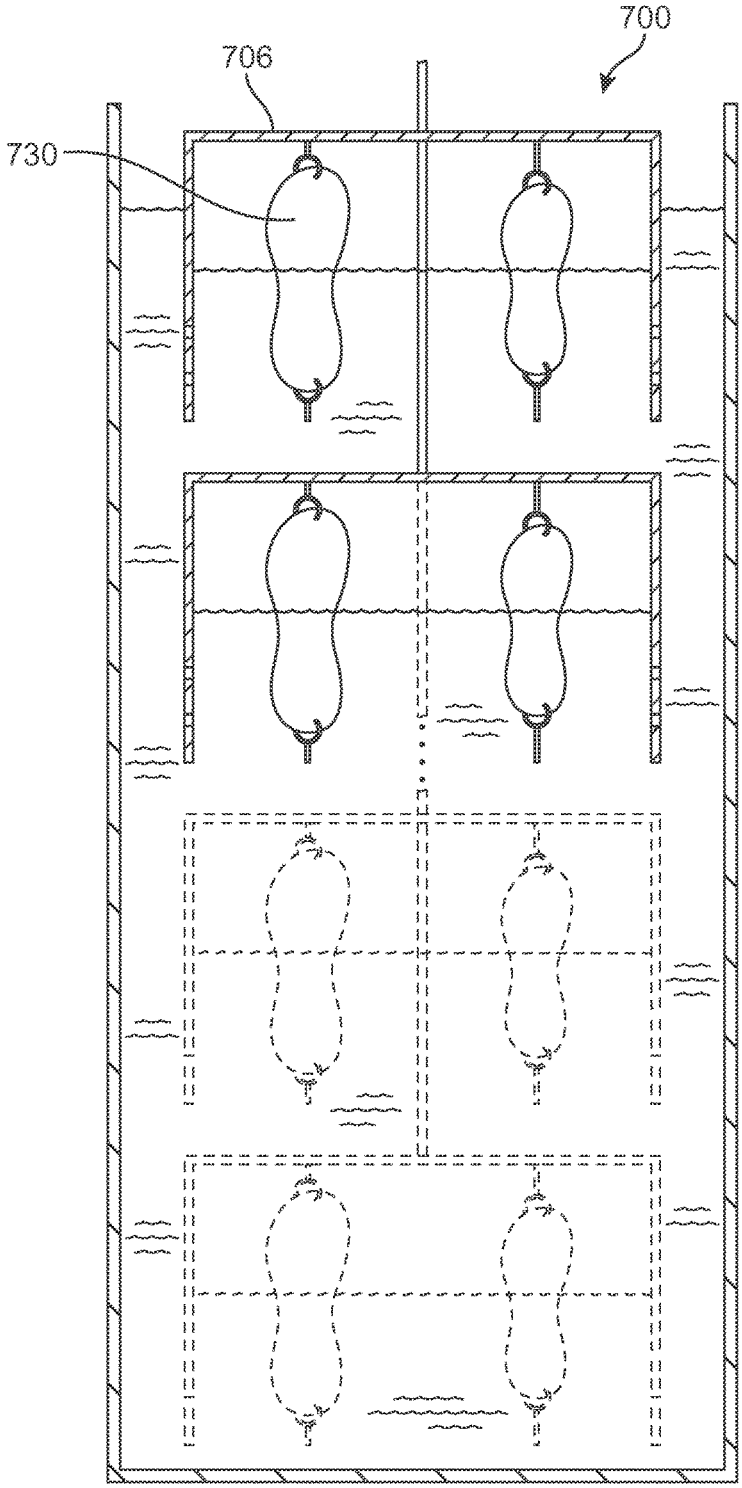
FIG. 17 is a schematic view of yet another embodiment of an apparatus used to produce multiple multicolored articles.

Although FIG. 16 illustrates an embodiment in which two containers are stacked or submerged simultaneously, other embodiments could include three or more containers. For example, FIG. 17 illustrates a schematic cross-sectional view of an assembly 700 that comprises multiple different containers 706 for holding multiple articles 730. In FIG. 17, phantom lines are used to indicate that any number of containers can be used in various embodiments.

While various embodiments have been described, the description is intended to be exemplary, rather than limiting and it will be apparent to those of ordinary skill in the art that many more embodiments and implementations are possible. Accordingly, the embodiments are not to be restricted except in light of the attached claims and their equivalents. Also, various modifications and changes may be made within the scope of the attached claims.

What is claimed is:

1. A method of coloring an article, comprising:

fastening an article to a container;

inserting at least a portion of the container into a liquid including a coloring agent associated with a color;

trapping a volume of air between a closed end of the container and a surface of the liquid to create an air pocket within the container;

preventing a first portion of the article disposed within the air pocket of the container from contacting the liquid due to a pressure of the air trapped in the air pocket; and introducing a second portion of the article into the liquid, thereby coloring the second portion of the article with the color;

wherein the pressure of the trapped air is controlled independent from the submersion depth of the container in the liquid.

2. The method according to claim 1, wherein the step of inserting at least a portion of the container into the liquid including the coloring agent includes the step of inserting an open end of the container into the liquid.

3. The method according to claim 2, further comprising inserting the closed end of the container into the liquid after the open end of the container is inserted into the liquid.

4. The method according to claim 2, further comprising maintaining the closed end of the container suspended above the liquid after the open end of the container is inserted into the liquid.

5. The method according to claim 1, wherein the container can be completely submerged into the liquid, while the air pocket is maintained.

6. The method according to claim 1, wherein the coloring agent includes a dye.

7. The method according to claim 1, further comprising a step of removing the container from the liquid and allowing the second portion to dry.

8. The method according to claim 1, wherein the second portion is a heel portion of the article.

9. The method according to claim 1, wherein the second portion is a fore foot portion of the article.

10. The method according to claim 1, wherein the second portion is a side portion of the article.

11. The method according to claim 1, further comprising the steps of:

removing the container from the liquid;

fastening the article to the container in an inverted position;

inserting at least a portion of the container into a second liquid including a second coloring agent associated with a second color;

creating an air pocket within the container, the second portion of the article being disposed within the air pocket of the container; and introducing the first portion of the article into the second liquid thereby coloring the first portion of the article with the second color.

12. A method comprising:

attaching an article to a container having an open end and a closed end;

inserting the open end into a liquid including a coloring agent;

causing the liquid to enter the open end of the container and contact a first portion of the article;

trapping a volume of air between the closed end of the container and a surface of the liquid;

contacting a second portion of the article with the air within the container;

preventing the second portion from contacting the liquid due to a pressure of the volume of trapped air; and controlling the pressure of the volume of trapped air independent from a submersion depth of the container in the liquid.

13. The method of claim 12, further comprising inserting the closed end of the container into the liquid after the open end is inserted into the liquid.

14. The method of claim 12, further comprising maintaining the closed end of the container above the liquid after the open end is inserted into the liquid.

15. The method of claim 12, further comprising increasing a pressure of the air as the open end of the container is inserted deeper into the liquid.

16. The method of claim 15, further comprising contacting more of the article with the liquid as the pressure of the air increases.

17. The method of claim 15, further comprising contacting less of the article with the air as the pressure of the air increases.

18. The method of claim 15, further comprising causing more liquid to enter the container as the pressure of the air increases.

* * * * *